US005460668A

United States Patent [19]

Lyon

[11] Patent Number: 5,460,668

[45] Date of Patent: Oct. 24, 1995

[54] NONAZIDE GAS GENERATING COMPOSITIONS WITH REDUCED TOXICITY UPON COMBUSTION

[75] Inventor: Lyman R. Lyon, Bloomfield Hills, Mich.

[73] Assignee: Automotive Systems Laboratory, Inc.

[21] Appl. No.: 273,312

[22] Filed: Jul. 11, 1994

[51] Int. Cl.[6] ..... C06B 47/08

[52] U.S. Cl. ..... 149/36; 149/61

[58] Field of Search ..... 149/61, 36

[56] References Cited

U.S. PATENT DOCUMENTS

| | | | |
|---|---|---|---|
| 3,912,561 | 10/1975 | Dion et al. | 149/35 |
| 4,608,102 | 8/1986 | Krampen et al. | 149/92 |
| 4,948,439 | 8/1990 | Poole et al. | 149/46 |
| 5,139,588 | 8/1992 | Poole et al. | 149/61 |
| 5,388,519 | 2/1995 | Guindon et al. | 102/292 |

OTHER PUBLICATIONS

Hausner, *Handbook of Powder Metallurgy*, 1973, pp. 8, 9, 14.

*Primary Examiner*—Donald P. Walsh
*Assistant Examiner*—Anthony R. Chi
*Attorney, Agent, or Firm*—Lyman R. Lyon

[57] ABSTRACT

Nonazide gas generating compositions are formed from a nonazide fuel, an oxidizer, and a heat absorbing additive in the form of a glass compound. The additive effects a reduction in the combustion temperature of the gas generant, thereby resulting in inflating gases having a reduced content of toxic gases such as $NO_x$ and CO. The gas generants are therefore nontoxic and useful for inflating a vehicle occupant restraint system.

6 Claims, No Drawings

NONAZIDE GAS GENERATING COMPOSITIONS WITH REDUCED TOXICITY UPON COMBUSTION

BACKGROUND OF THE INVENTION

The present invention relates generally to gas generating compositions used for inflating occupant safety restraints in motor vehicles, and more particularly to nonazide gas generants that produce combustion products having acceptable toxicity levels in the event of exposure to vehicle occupants.

Inflatable occupant restraint devices for motor vehicles have been under development worldwide for many years, including the development of gas generating compositions for inflating such occupant restraints. Because the inflating gases produced by the gas generants must meet strict toxicity requirements, most, if not all, gas generants now in use are based on alkali or alkaline earth metal azides, particularly sodium azide. When reacted with an oxidizing agent, sodium azide forms a relatively nontoxic gas consisting primarily of nitrogen. Moreover, combustion of azide-based gas generants occurs at relatively low temperatures, which enables the production of nontoxic inflating gases without a need for additives to reduce the combustion temperature.

However, azide-based gas generants are inherently difficult to handle and entail relatively high risk in manufacture and disposal. Whereas the inflating gases produced by azide-based gas generants are relatively nontoxic, the metal azides themselves are conversely highly toxic, thereby resulting in extra expense and risk in gas generant manufacture, storage, and disposal. In addition to direct contamination of the environment, metal azides also readily react with acids and heavy metals to form extremely sensitive compounds that may spontaneously ignite or detonate.

Another problem inherent in azide-based gas generants is the production of very fine toxic powders upon combustion. Exemplary of these very fine toxic powders are ions and oxides of alkali or alkaline earth metals, such as sodium metal or sodium peroxide, depending on which metal azide is utilized in the gas generant. These very fine toxic residues have been heretofore removed from the inflating gases produced by the azide-based gas generant by incorporating a low-temperature softening glass into the azide-based gas generant, as described in U.S. Pat. No. 4,021,275. The glass acts as a secondary media filter in order to remove the very fine toxic powders. In a first phase, the glass melts and absorbs dispersed toxic powders. In a second phase, the molten glass adheres to a primary filter, such as a wire net or mesh, and facilitates accretion of the fine toxic powders onto the primary filter mesh or net.

In contradistinction, nonazide gas generants provide significant advantages over azide-based gas generants with respect to toxicity related hazards during manufacture and disposal. Moreover, most nonazide gas generant compositions typically supply a higher yield of gas (moles of gas per gram of gas generant) than conventional azide-based occupant restraint gas generants.

However, nonazide gas generants heretofore known and used produce unacceptably high levels of toxic substances upon combustion. The most difficult toxic gases to control are the various oxides of nitrogen ($NO_x$) and carbon monoxide (CO).

Reduction of the level of toxic $NO_x$ and CO upon combustion of nonazide gas generants has proven to be a difficult problem. For instance, manipulation of the oxidizer/fuel ratio only reduces either the $NO_x$ or CO. More specifically, increasing the ratio of oxidizer to fuel minimizes the CO content upon combustion because the extra oxygen oxidizes the CO to carbon dioxide. Unfortunately, however, this approach results in increased amounts of $NO_x$. Alternatively, if the oxidizer/fuel ratio is lowered to eliminate excess oxygen and reduce the amount of $NO_x$ produced, increased amounts of CO are produced.

The relatively high levels of $NO_x$ and CO produced upon combustion of nonazide gas generants, as opposed to azide-based gas generants, are due primarily to the relatively high combustion temperatures exhibited by nonazide gas generants. For example, the combustion temperature of a sodium azide/iron oxide gas generant is 969° C. (1776° F.), while the nonazide gas generants exhibit considerably higher combustion temperatures, such as 1818° C. (3304° F.). Utilizing lower energy fuels to reduce the combustion temperature is ineffective because the lower energy fuels do not provide a sufficiently high gas generant burn rate for use in vehicle occupant restraint systems. The burn rate of the gas generant is important to ensure that the inflator will operate readily and properly.

Another disadvantage created by the high combustion temperatures exhibited by nonazide gas generants is the difficulty presented in forming solid combustion particles that readily coalesce into a slag. Slag formation is desirable because the slag is easily filtered, resulting in relatively clean inflating gases. In azide-based gas generants, the lower combustion temperatures are conducive to solid formation. However, many common solid combustion products which might be expected from nonazide gas generants are liquids at the higher combustion temperatures displayed by nonazide gas generants, and are therefore difficult to filter out of the gas stream.

Therefore, a need exists for a nonazide gas generant that can produce inflating gases at a desired high burn rate but at a relatively low combustion temperature so that toxic gases, for example, $NO_x$ and CO are minimized.

SUMMARY OF THE INVENTION

The aforesaid problems are solved, in accordance with the present invention, by a nonazide gas generating composition which is nontoxic itself, and also produces inflating gases upon combustion which have reduced levels of $NO_x$ and CO due to a reduced combustion temperature. The manufacturing, storage, and disposal hazards associated with unfired azide inflators are eliminated by the gas generant of the invention. The reduced content of toxic gases such as $NO_x$ and CO allow the gas generants of the present invention to be utilized in vehicle occupant restraint systems while protecting the occupants of the vehicle from exposure to toxic gases which heretofore have been produced by nonazide gas generants. The lower combustion temperatures produced by the present invention also facilitate the formation of solid combustion products which are easily filtered.

Specifically, the present invention comprises a nonazide fuel, an oxidizer, and a heat absorbing additive comprising glass powder. The glass powder softens but preferably does not melt upon combustion of the fuel thereby absorbing heat and reducing peak combustion temperature. The nonazide fuel is selected from the group consisting of tetrazoles, bitetrazoles, triazoles, and metal salts of these compounds. The oxidizer is preferably selected from the group consisting of inorganic nitrates, nitrites, chlorates, or perchlorates of alkali or alkaline earth metals. The powdered glass is selected from a group of powdered glasses that exhibit a relatively high "softening point."

DETAILED DESCRIPTION OF THE PREFERRED EMBODIMENT(S)

In accordance with the present invention, the fuel utilized in the nonazide gas generant is preferably selected from compounds that maximize the nitrogen content of the fuel and regulate the carbon and hydrogen content thereof to moderate values. Such fuels are typically selected from azole compounds or metal salts of azole compounds, particularly tetrazole compounds such as aminotetrazole, tetrazole, 5-nitrotetrazole, 5-nitroaminotetrazole, bitetrazole, and metal salts of these compounds, as well as triazole compounds such as 1,2,4-triazole-5-one or 3-nitro-1,2,4-triazole-5-one and metal salts of these compounds. A preferred embodiment utilizes 5-aminotetrazole as the fuel because of cost, availability and safety.

Oxidizers generally supply all or most of the oxygen present in the system. The oxidizer actively supports combustion and further suppresses formation of CO. The relative amounts of oxidizer and fuel used is selected to provide a small excess of oxygen in the combustion products, thereby limiting the formation of CO by oxidizing the CO to carbon dioxide. The oxygen content in the combustion products should be in the range of 0.1% to about 5% and preferably from approximately 0.5% to 2%. Typically, oxidizers are chosen from inorganic nitrates, nitrites, chlorates or perchlorates of alkali metals, alkaline earth metals or ammonium. Strontium and barium nitrates are easy to obtain in the anhydrous state and are excellent oxidizers. Strontium nitrate and barium nitrate are most preferred because of the more easily filterable solid products formed, as described hereinbelow.

A slag former may be optionally included in the gas generant in order to facilitate the formation of solid particles that may then be filtered from the gas stream. A convenient method of incorporating a slag former into the gas generant is by utilizing an oxidizer or a fuel which also serves in a dual capacity as a slag former. The most preferred oxidizer which also enhances slag formation is strontium nitrate, but barium nitrate is also effective. Generally, slag formers may be selected from numerous compounds, such as alkaline earth metal or transition metal oxides, hydroxides, carbonates, oxalates, peroxides, nitrates, chlorates, and perchlorates, or alkaline earth metal salts of tetrazoles, bitetrazoles and triazoles, as well as other compounds.

Another optional additive is an alkali metal salt, which may be mixed into the gas generant. The alkali metal salt allows formulation of the gas generant to provide an excess of oxygen in the combustion products, which reduces the amount of CO. The alkali metal preferably should be incorporated into the gas generant as part of an organic compound, most preferably as a salt of an organic acid, rather than as an inorganic compound. For gas generants used in automobile air bags, it is advantageous to use compounds which have a high nitrogen content, such as alkali metal salts of tetrazoles or triazoles. These materials serve multiple functions when incorporated into the gas generant because they function as fuels which produce useful gases.

The range of alkali metal compounds which can be effectively used in a gas generant is quite broad. For example, as little as 2% of the potassium salt of 5-aminotetrazole (K5-AT) is effective as an additive, and in cases where the K5-AT also serves as the primary fuel and gas producer, up to about 45% is used. The preferred range is about 2 to about 20% by weight and the most preferred range is from about 2 to about 12% by weight. The alkali metal salts of 5-aminotetrazole, tetrazole, bitetrazole and 3-nitro-1,2,4-triazole-5-one (NTO) are usable because of their high nitrogen content. Lithium, sodium and potassium are preferred alkali metals, but rubidium and cesium may also be utilized. The most preferred alkali metal salt is the potassium salt of 5-aminotetrazole.

In accordance with the present invention, the heat absorbing additive which reduces the combustion temperature of the gas generant, and therefore the production of $NO_x$, comprises a high-temperature softening powdered glass compound. The glass additive, which is mixed directly into the gas generating composition, absorbs heat energy by softening while the fuel and oxidizer react. By absorbing heat during the combustion process, the glass additive advantageously reduces the combustion temperature, which in turn minimizes the formation of toxic $NO_x$, while still permitting the use of high energy fuels to maintain the necessary burn rate. CO production is attenuated by the use of a relatively larger percentage of oxidizer. This synergistic relationship precludes the formation of $NO_x$ from the excess oxygen. Filtration is not problematic, because the softened glass particles stick to the filter and further facilitate entrapment of solid particles. The type of glass selected as the additive is based on the ability of the glass to absorb heat and therefore reduce the combustion temperature. The amount of glass additive is preferably within the range of about 0.1% by weight to about 10% by weight of the gas generant mix. Larger weight percentages of the glass additive are not effective because of undesirable attenuation of the gas generant burn rate. The size of the glass particles preferably range from 5 to 300 microns.

The types of glass that are effective vary depending upon the combustion temperature of a particular nonazide fuel and oxidizer. The glass compound utilized is preferably a high-temperature softening glass, because of the aforesaid high temperatures typically exhibited by nonazide gas generants.

It is to be noted that the absorption of heat by glass varies according to phase. The "softening point" of a glass is determined by an ASTM standardized test based on the fact that glass at a certain viscosity will deform at a certain temperature. The term "high temperature softening point," for the purposes of this application is a softening point over approximately 590° C. (1094° F.). The term "melting" temperature as applied to glass is relatively higher than the "softening point." The term "working point" is the temperature at which glass flows freely.

One characteristic of glass that dictates the type of glass used in the practice of the instant invention is that glass absorbs the most heat when converting from the "softened" phase to the liquid phase, i.e., upon "melting." After the glass melts, the glass will still remove heat, but only until an equilibrium is reached, after which the glass will no longer absorb any significant amount of heat. It is also to be noted that since powdered glass is the form of glass that is most conducive to absorbing heat in a given time frame, powdered glass is the form of choice.

Another factor that must be considered is that molten glass is relatively difficult to filter from the combustion product of the gas generant while softened glass powder is relatively easier to filter. Thus, a glass powder having a "melting" temperature approaching but somewhat below the peak combustion temperature of gas generant is desirable to maximize heat absorption but minimize "melting."

Set in the above context, PYREX glass brand No. 7740, which is available from Corning, Inc.,, Advanced Materials Business, HP CB-1-6, Corning, New York, 14831, in powdered form, has the following characteristics: a strain point of 510° C. (950° F.), an annealing point of 560° C. (1040° F.), and a softening point of 821° C. (1510° F.). Alternatively, VYCOR glass brands No. 7913 and 7930 may be used when the gas generant exhibits a relatively higher peak burn temperature. Such glasses are also available in powdered form from Corning, and have the following characteristics: a strain point of 890° C. (1634° F.), an annealing point of 1020° C. (1868° F.), and a softening point of 1530° C. (2786° F.). Other examples of powdered glass available from Corning that have high softening points include alkaline earth aluminosilicate, aluminosilicate, baria alumina borosilicate, barium alumino borosilicate, and fused silica. The attenuated combustion temperatures exhibited by the present invention are relatively conducive to solid slag formation.

One skilled in the art will readily appreciate the manner in which the aforesaid combinations of ingredients are combined to form the gas generant compositions of the present invention. For example, the materials may be dry-blended and attrited in a ball-mill and then pelletized by compression molding. The present invention may be exemplified by the following representative examples wherein the components are quantified in weight percent.

EXAMPLE 1

A mixture of 5-aminotetrazole (5-AT), strontium nitrate [$Sr(NO_3)_2$], K5-AT, and powdered PYREX glass brand No. 7740 is prepared having the following composition in percent by weight: 28.62% 5-AT, 57.38% $Sr(NO_3)_2$, 6.00% K5-AT, and 8.00% PYREX powder.

The above materials are dry-blended, attrited in a ball-mill, and pelletized by compression molding.

EXAMPLE 2

A mixture of 5-AT, $Sr(NO_3)_2$, K5-AT, and powdered VYCOR glass brand 7913 is prepared as described in Example 1 having the following composition in percent by weight: 28.62% 5-AT, 57.38% $Sr(NO_3)_2$, 6.00% K5-AT, and 8.00% VYCOR powder. The materials are prepared as described in Example 1.

EXAMPLE 3

A mixture of 5-AT, $Sr(NO_3)_2$, K5-AT, and PYREX is prepared having the following composition in percent by weight: 27.62% 5-AT, 57.38% $Sr(NO_3)_2$, 5.00% K5-AT, and 10.00% PYREX powder. The materials are prepared as described in Example 1.

EXAMPLE 4

A mixture of 5-AT, $Sr(NO_3)_2$, K5-AT, and VYCOR glass brand 7930 is prepared as described in Example 1 having the following composition in percent by weight: 28.62% 5-AT, 57.38% $Sr(NO_3)_2$, 9.00% K5-AT, and 5.00% VYCOR powder. The materials are prepared as described in Example 1.

EXAMPLE 5

A mixture of 5-AT, $Sr(NO_3)_2$, K5-AT, and PYREX is prepared having the following composition in percent by weight: 25.62% 5-AT, 60.38% $Sr(NO_3)_2$, 9.00% K5-AT, and 5.00% PYREX powder. The materials are prepared as described in Example 1.

While the preferred embodiment of the invention has been disclosed, it should be appreciated that the invention is susceptible of modification without departing from the scope of the following claims.

What is claimed is:

1. A nonazide gas generating composition that forms gases upon combustion useful for inflating a vehicle occupant safety restraint device comprising:

a nonazide fuel;

an oxidizer; and a heat absorbing additive comprising a powdered glass compound having a softening point in excess of approximately 590° C. (1094° F.) for absorbing heat upon combustion of said fuel so as to reduce the combustion temperature thereof; provided that the heat absorbing additive is selected from the group consisting of PYREX, VYCOR compounds, alkaline earth aluminosilicate, aluminosilicate, baria alumina borosilicate, and barium alumino borosilicate.

2. The nonazide gas generant of claim 1 wherein said heat absorbing glass compound has a particle size of from about 5 to about 300 microns.

3. The nonazide gas generant of claim 1 wherein said nonazide fuel is selected from the group consisting of tetrazoles, bitetrazoles, triazoles, and metal salts of these compounds.

4. The nonazide gas generant of claim 1 wherein said oxidizer is selected from the group consisting of inorganic nitrates, nitrites, chlorates or perchlorates of alkali or alkaline earth metals.

5. The nonazide gas generant of claim 1 wherein the ratio of oxidizer to fuel is selected to provide a small excess of oxygen in the combustion products, with an oxygen content less than approximately 5% in the combustion products.

6. The nonazide gas generant of claim 1 wherein said heat absorbing additive is present in an amount of from about 0.1% by weight to about 10% by weight.

* * * * *